United States Patent [19]

Koffski

[11] Patent Number: 4,754,841

[45] Date of Patent: Jul. 5, 1988

[54] PORTABLE STEP

[76] Inventor: Leonard E. Koffski, R.R. 4, Box 13 - 7364 Trans Canadian Highway, Duncan, British Columbia, Canada, V9L3W8

[21] Appl. No.: 119,960

[22] Filed: Nov. 13, 1987

[51] Int. Cl.[4] ..... E06C 7/08

[52] U.S. Cl. ..... 182/92; 182/100; 182/189; 248/217.1; 248/246

[58] Field of Search ..... 182/90, 92, 100, 189; 248/218.4, 216.1, 217.1, 246

[56] References Cited

U.S. PATENT DOCUMENTS

| | | | |
|---|---|---|---|
| 141,498 | 8/1873 | Edmonston | 248/246 |
| 472,514 | 4/1892 | Sankey | 248/218.4 |
| 789,843 | 5/1905 | Dennis | 248/246 |
| 1,098,945 | 6/1914 | Frederick | 182/187 |
| 1,153,371 | 9/1915 | Carter | 182/189 |
| 1,597,095 | 8/1926 | Martinsen | 248/246 |
| 2,086,280 | 7/1937 | Matter | 248/246 |
| 3,166,868 | 1/1965 | Prozeller | 248/246 |
| 3,561,563 | 2/1971 | Harsh | 182/92 |
| 3,710,734 | 1/1973 | Bofferding | 248/246 |

*Primary Examiner*—Reinaldo P. Machado

*Attorney, Agent, or Firm*—Stevens, Davis, Miller & Mosher

[57] ABSTRACT

This invention is a simple to make, simple to use, inexpensive step for use on rectangular wooden posts, such as those used in scaffolds. This step has a u shaped body with a portion that encompasses the posts, two "grips" in this portion which bite into the wood to keep the step in place, and a part to step upon. To move this step to a desired position, the part that is stepped upon is tilted up and out from the horizontal. This motion causes the two grips to disengage from the post and to be sufficiently removed from the post to allow the step to slide freely on this post. The step is fabricated from a single sheet of metal that is cut and bent to the desired design.

14 Claims, 2 Drawing Sheets

PORTABLE STEP

BACKGROUND OF THE INVENTION

This invention relates generally to small scaffolds and specifically to a detachable, independent step for use in connection with a small scaffold.

Various designs for vertically movable steps on posts are known. For example, U.S. Pat. No. 3,561,563 to Harsch discloses a portable step for use on a substantially vertical post. This simple design step attaches from the side. When tilted from the horizontal the step can slide vertically on the post. When in used, the step is substantially horizontal, and the edges of the step engage and bite into the post. Due to gravity any weight load on the step increases the force with which the step engages the post. However, there are problems with this design. The strength of the step is a function of the strength of the materials of which the step is constructed. Undetected flaws in the step material could result in catastrophic collapse during use. Further, these materials may be relatively expensive.

U.S. Pat. No. 2,086,280 to Matter is an angle bracket support for use on a substantially vertical post. This horizontal support could be used as a step, a support for equipment, or for a horizontal member on a scaffold. Though of a different design, Matter's portable support functions very much like Harsh's step. Matter's step uses a complicated mechanical design to give this support its requisite strength. The support has a relatively long vertical element flush with the post, a web between the horizontal support and vertical element, and a large flange which extends around the post to strengthen the structure. The detailing of this structure makes it relatively expensive to manufacture.

U.S. Pat. No. 1,098,945 to Frederick discloses a movable pole scaffold connected to a substantially vertical post. This design also uses gravitational force of the load on the horizontal element to make connection of the scaffold to the post stronger. This design is comprised of a horizontal element which supports weight connected to a yoke. The horizontal element edge, yoke legs, and a rod that transverses the yoke legs all engage the post. The problem with this design is if the transverse rod should disengage from the yoke legs or if the horizontal element should separate from the yoke the step would catastrophically fail.

SUMMARY OF THE INVENTION

This invention discloses a portable step designed to be strong and inexpensive to manufacture. The step design is stamped out of a relatively thin metal sheet that is then folded and secured such as by welding to form the step. This step gains its structural strength from its three-dimensional design rather from the materials from which it is made. Further, this step utilizes unique post-engaging means of triangularly shaped teeth which bite into the post.

BRIEF DESCRIPTION OF THE DRAWINGS

Aspects of the invention are illustrated in the following drawings.

DETAILED DESCRIPTION OF THE INVENTION

Figure 1:
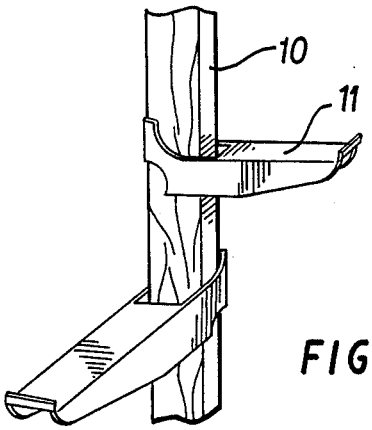
FIG. 1 is a perspective view of the step on a post.
Figure 2:
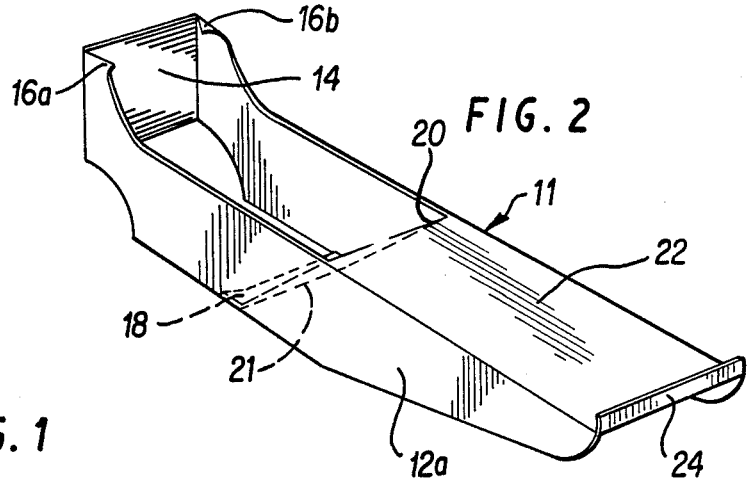
FIG. 2 is a perspective view of the step.

FIG. 1 shows two different forms of the step 11 on a rectangular post 10. Post 10 most conveniently is a wooden two-by-four extending substantially vertically. Step 11 initially is put on post 10 over one of the post's ends. To slide easily along post 10, step 11 must have its weight supporting end (i.e., horizontal member 22, as shown in FIG. 2) tilted upwardly and backwardly toward post 10. When released and gravity pulls the weight-supporting end to a substantially horizontal position, top grips 16*a* and 16*b* and bottom grip 18 contact post 10 and hold step 11 in a stationary position. Weight on step 11 causes top and bottom grips 16*a* and 16*b* and 18 to dig into the wooden post 10 stabilizing and strengthening the step's contact to the post 10.

As shown in FIG. 1, the step may be in two different forms or shapes, that is either to project out from a narrow side of a rectangle (in a 2×4, the nominal 2 inch side), or from a wide side of a rectangle (in a 2×4, the nominal 4 inch side), a square or round post could also be used with an appropriately shaped step.

FIG. 2 shows the basic elements of this portable step design. Step 11 has a stepping surface 22 which supports weight. Structurally, stepping surface 22 is supported by a pair of side pieces 12*a* and 12*b*. Side pieces 12*a* and 12*b* also contact post 10. Side pieces 12*a* and *b* are interconnected not only by stepping surface 22, but also by an upstanding foot retainer 24 on one end, a planar member 14 at the other end, and the bottom grip 18 across the side pieces' bottom edges. Both the planar member 14 and bottom grip 18 contact the post 10 when the step 11 is in its use position. A top grip 16 is positioned in the corners between planar member 14 and side pieces 12*a*, 12*b* and may be secured on the top edge of the planar member 14 or on the top edge of one or both of side pieces 12*a* and 12*b* (preferably touching the planar member 14). In the preferred embodiment of this invention, top grip 16 is comprised of a pair of triangular pieces 16*a* and 16*b* positioned both said corners on the top edge of the side pieces 12*a* and 12*b*, and touching the planar member 14.

Figure 3:
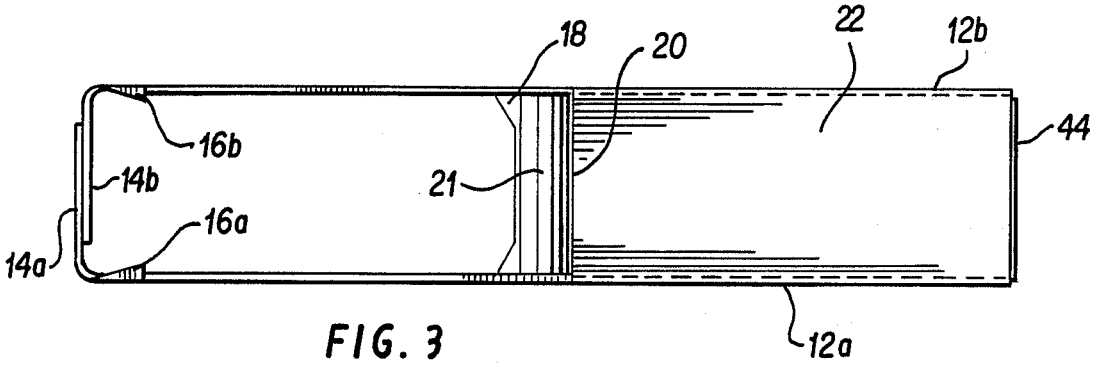
FIG. 3 is a top elevational view of the assembled step.
Figure 4:
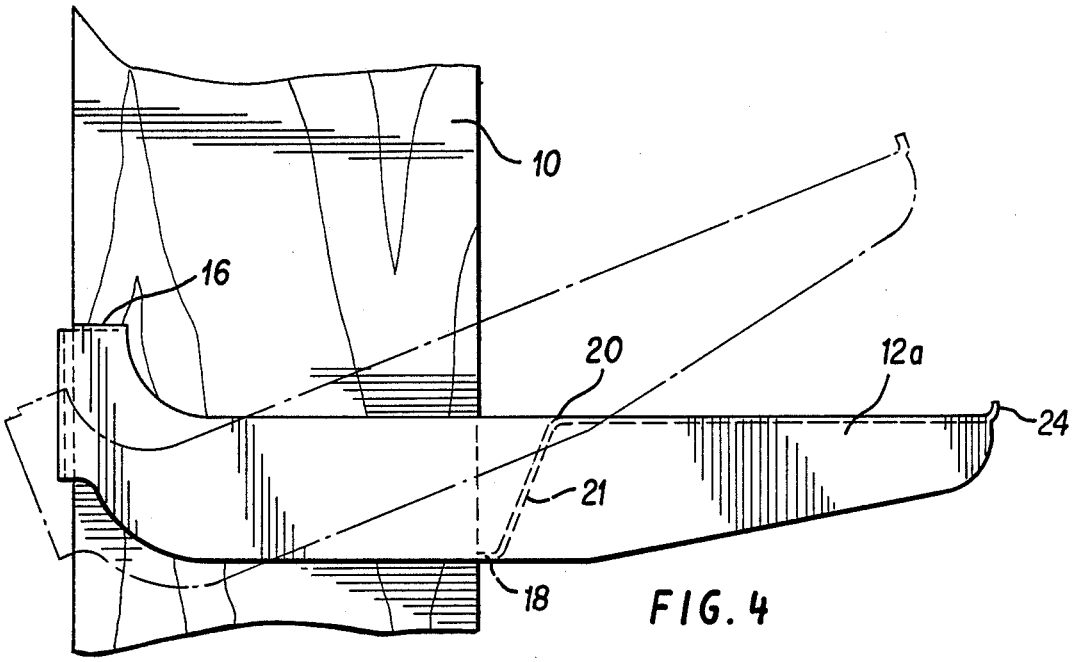
FIG. 4 is a side view of the step on a post in solid lines in the stationary position and dashed lines in the movable position.

FIGS. 3 and 4 show how the step is moved on the post and the structure that allows this. FIG. 4 especially shows how the top and bottom grips 16 and 18 contact the post. The step is capable of easy vertical movement on the post due to the shape and positon of rigid member 21. Member 21 is perpendicular to and bridges between side pieces 12*a* and 12*b*. Member 21 lies at an angle in relation to planar member 14 so that a projection from the surfaces of each would form an acute angle of between 60–80 degrees, preferably 70 degrees. The straight line distance between the upper edge 20 of member 21 and the outer edge of grip 16 must be greater than the thickness of the post upon which it is mounted in order to permit free sliding movement of the step 11 on the post when the step 11 is tilted upwardly out of the horizontal position because an angle is formed by the bottom grip 18, rigid member 21, and the post 10, the step 11 should be tilted to clear both grips 16 and 18. Once tilted, the step 11 may slide freely on the post 10.

Figure 5:
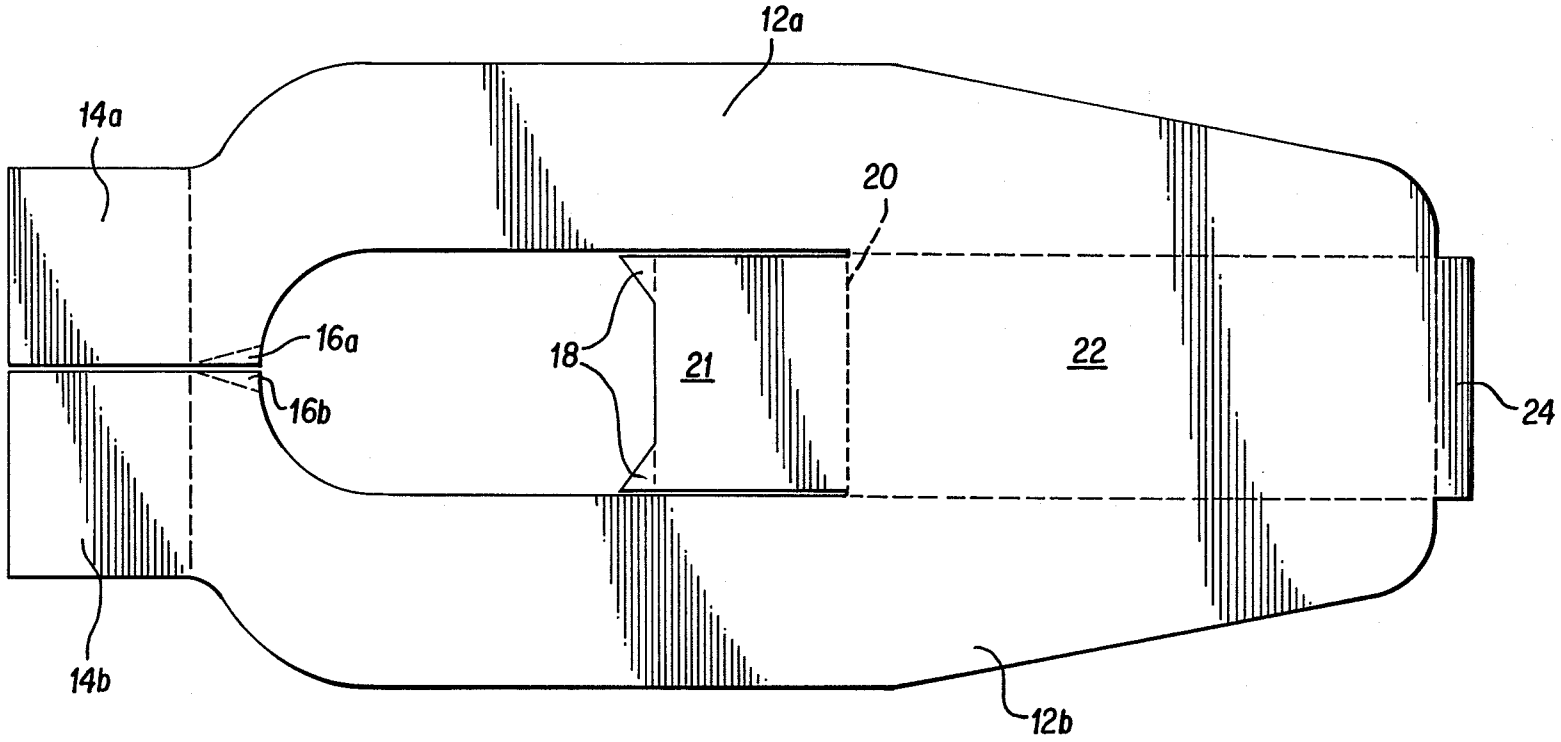
FIG. 5 is a top elevational view of the step pattern as stamped out of a sheet of metal prior to bending and assembly.

FIG. 5 shows the step's design as stamped out of a flat sheet of bendable metal. In this illustration, for purpose of clarity it is shown that where the material is bent from the plant a dash line is used. A solid line denotes a cut through the material. After bending side pieces 12*a* and 12*b* down to be perpendicular to stepping surface 22, end tabs 14*a* and 14*b* are bent toward each other. This causes end tabs 14*a* and 14*b* to overlap one another and both tabs are then perpendicular to stepping surface 22 and to side pieces 12*a* and 12*b*. Tabs 14*a* and 14*b* are then permanently affixed to each other by welding if the metal is not sufficiently stiff to stay in place of its own accord, forming planar member 14. Member 21 is bent downwardly from stepping member 22, while bottom grip 18 is bent to remain parallel to stepping member 22. Member 21 is only bent so far as necessary to allow bottom grip 18 to be even with the respective bottom edges of side pieces 12*a* and 12*b*. Bottom grip 18 is there permanently affixed, for example by welding if the metal is not sufficiently stiff. Foot retainer 24 is bent upwardly from stepping surface 22. Triangular pieces 16*a* and 16*b* are bent downward from side pieces 12*a* and 12*b* to form top grip 16. The thus formed step is thus free of any strain points. Only one seam is in planar number 14 where the metal is double due to the overlap joint as best seen in FIG. 3. A butt jam could also be used with an accompanying saving of material. Similarly, the metal used to form member 21 could be saved and a short piece of metal or a pin, preferably with a sharp edge of protruding corners, could be welded or otherwise secured so as to span across between side pieces 12*a* and 12*b* so as to serve the function of bottom grip 18. It is also contemplated that the step of this invention could be made of a plastic material such as an integrally molded one piece construction.

The foregoing description is given by way of example to illustrate one preferred embodiment. However, the scope of protection is defined only by the following claims.

What is claimed is:

1. A portable, vertically movable step, for connection to a substantially vertical, rectangular post, comprising:
   (a) a substantially U shaped body formed of sheet material and having a pair of planar parallel side pieces spaced apart so as to encompass and contact two opposite sides of said rectangular post;
   (b) said side pieces having sufficient length to present two legs that extend outwardly beyond the side of the post they encompass;
   (c) the bight of said U shaped body being planar and positioned to contact a third side of said rectangular post;
   (d) means to contact the fourth side of said rectangular post when said step is in a substantially horizontal position but to avoid contact with said fourth side when the legs are tilted upwardly away from said substantially horizontal position so that said step, when in the tilted position, may then be moved upwardly and downwardly on said post.

2. The step of claim 1 including a post gripping means on the bight of said body.

3. The step of claim 2 in which said gripping means is at least one pointed member protruding outwardly toward said post so as to engage said post when the step is substantially horizontal.

4. The step of claim 1 in which said means to contact the fourth side of said post comprising at least one protruding member having an edge and connected to said side piece, said edge being adjacent said post to engage said fourth side of the post.

5. The step of claim 4 in which said protruding member is a wall having a plane that is at an angle in relation to said planar bight so that a projection of the plane of said bight and the plane of said wall forms an acute angle below said body.

6. The step of claim 1 including an upper surface on said legs to form a stepping surface.

7. A portable, vertically movable step, for connection to a substantially vertical, rectangular post, comprising:
   (a) a substantially U shaped body having a pair of parallel side pieces spaced apart so as to encompass and contact two opposite sides of said rectangular post;
   (b) said side pieces having sufficient length to present two legs that extend outwardly beyond the side of the post they encompass;
   (c) the bight of said U shaped body being positioned to contact a third side of said rectangular post;
   (d) means to contact the fourth side of said rectangular post when said step is in a substantially horizontal position but to avoid contact with said fourth side when the legs are tilted upwardly away from said substantially horizontal position so that said step, when in the tilted position, may then be moved upwardly and downwardly on said post.

8. The step of claim 7 made of a single piece of sheet metal bent to form the parts thereof.

9. The step of claim 7 made of integrally molded plastics material.

10. The step of claim 7 including a post gripping means on the bight of said body.

11. The step of claim 10 in which said gripping means is at least one pointed member protruding outwardly toward said post so as to engage said post when the step is substantially horizontal.

12. The step of claim 7 in which said means to contact the fourth side of said post comprises at least one protruding member having an edge and connected to said side piece, said edge being adjacent said post to engage said fourth side of the post.

13. The step of claim 12 in which said protruding member is a wall having a plane and said bight has a plane, said wall being positioned so that its plane is at an angle in relation to said planar bight so that a projection of the plane of said bight and the plane of said wall forms an acute angle below said body.

14. The step of claim 7 including an upper surface on said legs to form a stepping surface.

* * * * *